US011053762B2

(12) United States Patent
Gill et al.

(10) Patent No.: US 11,053,762 B2
(45) Date of Patent: Jul. 6, 2021

(54) DISSOLVABLE THREAD TAPE AND PLUGS FOR WELLS

(71) Applicant: Conocophillips Company, Houston, TX (US)

(72) Inventors: Gregory E. Gill, Houston, TX (US); Charles Colpitt, Houston, TX (US)

(73) Assignee: CONOCOPHILLIPS COMPANY, Houston, TX (US)

( * ) Notice: Subject to any disclaimer, the term of this patent is extended or adjusted under 35 U.S.C. 154(b) by 62 days.

(21) Appl. No.: 16/577,509

(22) Filed: Sep. 20, 2019

(65) Prior Publication Data

US 2020/0095840 A1 Mar. 26, 2020

Related U.S. Application Data

(60) Provisional application No. 62/734,191, filed on Sep. 20, 2018.

(51) Int. Cl.

| | |
|---|---|
| ***E21B 29/02*** | (2006.01) |
| ***E21B 33/12*** | (2006.01) |
| ***E21B 47/117*** | (2012.01) |

(52) U.S. Cl.

CPC ..... *E21B 29/02* (2013.01); *E21B 33/12* (2013.01); *E21B 47/117* (2020.05)

(58) Field of Classification Search

CPC ..... E21B 29/02; E21B 33/1208; E21B 47/117

See application file for complete search history.

(56) References Cited

U.S. PATENT DOCUMENTS

| | | | | |
|---|---|---|---|---|
| 3,163,218 | A | 12/1964 | Allen et al. | |
| 3,273,641 | A | 9/1966 | Bourne | |
| 3,880,233 | A | 4/1975 | Muecke et al. | |
| 4,018,283 | A | 4/1977 | Watkins | |
| 4,202,411 | A | 5/1980 | Sharp et al. | |
| 4,930,573 | A * | 6/1990 | Lane | E21B 33/122 166/120 |
| 5,320,178 | A | 6/1994 | Cornette | |
| 5,355,956 | A | 10/1994 | Restarick | |
| 5,479,986 | A | 1/1996 | Gano | |
| 5,607,017 | A | 3/1997 | Owens et al. | |
| 5,685,372 | A | 11/1997 | Gano | |
| 5,765,641 | A | 6/1998 | Shy | |
| 5,837,656 | A | 11/1998 | Sinclair et al. | |

(Continued)

FOREIGN PATENT DOCUMENTS

| | | | | |
|---|---|---|---|---|
| GB | 2503561 | A * | 1/2014 | F16L 55/1108 |
| WO | 2017200864 | | 11/2017 | |
| WO | 2017209914 | | 12/2017 | |

OTHER PUBLICATIONS

PCT written opinion for related application, No. PCT/US14/040326, dated Sep. 10, 2014.

(Continued)

*Primary Examiner* — Shane Bomar

(74) *Attorney, Agent, or Firm* — Boulware & Valoir

(57) ABSTRACT

Methods of plugging a hydrocarbon well by using degradable plugs plus a degradable tape to ensure pressure testing to 10,000 psi. When the plug is no longer needed, a degradation fluid or fluids are pumped downhole and that fluid or fluids degrade the degradable plugs and degradable tape, thus avoiding the production of any solids large enough to clog or block equipment.

25 Claims, 8 Drawing Sheets

(56) References Cited

U.S. PATENT DOCUMENTS

| | | | | |
|---|---|---|---|---|
| 6,220,350 | B1 | 4/2001 | Brothers | |
| 6,380,138 | B1 | 4/2002 | Ischy et al. | |
| 7,380,600 | B2 | 6/2008 | Wilberg | |
| 7,409,999 | B2 | 8/2008 | Henriksen | |
| 7,493,956 | B2 | 2/2009 | Shaw et al. | |
| 7,673,678 | B2 | 3/2010 | MacDougall | |
| 8,276,670 | B2 | 10/2012 | Patel | |
| 8,887,816 | B2 | 11/2014 | Liang et al. | |
| 9,151,143 | B2 | 10/2015 | Holdereman et al. | |
| 9,416,903 | B2 | 8/2016 | Osaland et al. | |
| 9,757,796 | B2 | 9/2017 | Sherman et al. | |
| 9,845,659 | B2 | 12/2017 | Mandell | |
| 9,856,714 | B2 * | 1/2018 | Giroux | E21B 33/146 |
| 2002/0174986 | A1 * | 11/2002 | Szarka | E21B 33/146 166/289 |
| 2005/0205264 | A1 | 9/2005 | Starr et al. | |
| 2008/0156498 | A1 | 7/2008 | Phi | |
| 2008/0296024 | A1 | 12/2008 | Huang et al. | |
| 2011/0247834 | A1 | 10/2011 | Gambier | |
| 2011/0308646 | A1 * | 12/2011 | Colpan | F16K 37/0008 137/556.6 |
| 2013/0062072 | A1 | 3/2013 | Alvarez et al. | |
| 2013/0075112 | A1 | 3/2013 | Franklin | |
| 2013/0220599 | A1 * | 8/2013 | Rae | E21B 43/123 166/250.01 |
| 2013/0240200 | A1 * | 9/2013 | Frazier | E21B 33/134 166/135 |
| 2013/0240201 | A1 * | 9/2013 | Frazier | E21B 33/134 166/135 |
| 2014/0027127 | A1 * | 1/2014 | Frazier | E21B 34/063 166/376 |
| 2015/0119301 | A1 | 4/2015 | McDaniel et al. | |
| 2015/0240584 | A1 | 8/2015 | Desai et al. | |
| 2015/0354310 | A1 | 12/2015 | Zaiser | |
| 2017/0107775 | A1 * | 4/2017 | Maenza | E21B 23/06 |
| 2017/0234103 | A1 | 8/2017 | Frazier | |
| 2018/0051533 | A1 | 2/2018 | Zbranek et al. | |
| 2018/0171783 | A1 * | 6/2018 | van Pol | H05K 5/06 |
| 2018/0328140 | A1 * | 11/2018 | Schmidt | E21B 34/063 |

OTHER PUBLICATIONS

Miller-Chou, B.A., & Koenig J.L, A review of polymer dissolution, Prog. Polym. Sci. 28 (2003) 1223-1270, available online at wwwcourses.sens.buffalo.edu/ce435/Koenig03.pdf.

International Search Report, PCT/US2019/052171, dated Nov. 22, 2019 (2 pages).

* cited by examiner

FIGURE 1: Prior art thread tape

DISSOLVABLE THREAD TAPE AND PLUGS FOR WELLS

PRIOR RELATED APPLICATIONS

This application claims priority to U.S. Ser. No. 62/734,191, filed on Sep. 20, 2018, and incorporated by reference in its entirety for all purposes.

FIELD OF THE INVENTION

The invention relates to methods, systems and devices for temporary plugging of wells or a portion thereof. In particular, degradable thread tape and plugs are provided that leaves zero or nearly zero solid debris once removed.

BACKGROUND

Well completion equipment is installed in hydrocarbon producing wells to facilitate the production of hydrocarbons from subsurface formations to the well surface. Temporary plugs are installed in the production tubing to accomplish various tasks. For example, a temporary plug can be installed in the lower end of the production tubing to permit tests for the pressure bearing integrity of the tubing. Additionally, the plug can permit the selective pressurization of the tubing to permit the operation of pressure sensitive tools within the tubing.

Temporary plugs are typically removed from the well by mechanical retrieval techniques such as wirelines, slick lines, and coiled tubing. Because other well operations cannot be performed during such work, the retrieval of the temporary plug delays the well operations and adds additional cost to the well operations. Thus, temporary plugs have been designed that do not require retrieval. In particular, several groups have designed dissolving plugs that can be solubilized at will and thereby avoid any mechanical retrieval processes.

U.S. Pat. No. 5,607,017, for example, describes a dissolving plug that can be used for temporary plugging of a well. These inventors suggest using Series 300-301 dissolvable metal manufactured by TAFA Incorporated of Concord, N.H. Such material has strength and machinability characteristics of certain metals, but will disintegrate when exposed to water.

U.S. Pat. No. 9,151,143 describes acid soluble metals including, but not limited to, barium, calcium, sodium, magnesium, aluminum, manganese, zinc, chromium, iron, cobalt, nickel, tin, any alloy thereof, or any combination thereof. US20150354310 describes dissolvable resin and fiber plugs.

U.S. Pat. Nos. 9,416,903 and 7,493,956 describe hydrate plugs made of a material similar to wax, that can be dissolved by means of heat or by means of a hydrate dissolving fluid, for example methanol, monoethylene glycol, diesel, and the like.

US20050205264 describes plugs made of an epoxy resin, a fiberglass, or a combination thereof, that can be dissolved with caustic or acidic fluids.

U.S. Pat. No. 9,757,796 teaches wrought magnesium dissolvable alloys.

Although a great benefit, some issues remain to be solved with dissolving plugs. One problem is the need for the plug to withstand pressure tests of up to 10,000 psi. Currently, threaded plugs are set with 3-4 wraps of TEFLON™ tape (PTFE—polytetrafluoroethylene) in order to pass the pressure tests. However, although the plugs themselves dissolve, the TEFLON™ tape does not, and the small pieces can clog nozzles, sensors, and other small devices, and can also plug surface equipment if produced to surface.

Thus, what is needed in the art are better methods, devices and systems to allow temporary plugs to pass stringent pressure testing, yet not leave behind any non-dissolving components that can impact well production and/or control equipment.

SUMMARY

The present disclosure provides a degradable tape used downhole with degradable plugs. Thus, with the use of one or more degrading fluid(s), the plug and the tape can be removed without needing to pull string or deploy wireline or anything else down hole beside the actual degradation fluid(s). The invention also includes degradable plugs wrapped in degradable tape, as well as oil well casings, liners and tubings containing same, and various methods of deploying these.

In more detail, the invention includes any one or more of the following embodiment(s) in any one or more combination(s) thereof:

A method of temporarily plugging a hydrocarbon well, comprising:

a) providing a section of tubing in a well, the tubing having one or more ports therein, each of the one or more ports having a degradable plug having threads therein, the threads wrapped with a degradable thread tape, the degradable plug and the degradable tape arranged so as to plug each of the one or more ports, thus providing a plugged section of well;

b) performing a downhole activity in the plugged section for a period of time; and c) providing one or more degrading fluid(s) downhole to degrade the degradable plug and the degradable tape, thereby opening the plugged section.

Any method herein, wherein the section of well is a toe section.

Any method herein, the method further comprising providing one or more blocking devices above and below the section, wherein the blocking devices are selected from a plug, a packer, a basket, or combinations thereof.

A method of temporarily plugging a hydrocarbon well, comprising:

a) deploying a first blocking device downhole to block a bottom of a section of well to be plugged, the section of well having tubing with one or more ports plugged with a degradable plug having threads, the threads wrapped with a degradable thread tape;

b) deploying a second blocking device above the section, thereby providing a plugged section;

c) pressure testing the plugged section for a period of time to confirm that the plugged section will hold at least 5,000 psi for 12 hours; and d) deploying one or more aqueous degrading fluid(s) downhole to degrade the degradable plug and the degradable tape in 48 hours or less, preferably in 24 hours or less or overnight.

A hydrocarbon well, the hydrocarbon well comprising a tubing in an underground reservoir of hydrocarbon, the tubing having holes therein, the holes blocked with a degradable plug wrapped with degradable tape, the degradable plug wrapped with degradable tape able to withstand least 5,000 psi for 12 hours.

Any method or well herein, wherein the degradable plug and the degradable tape are degradable in aqueous solutions in less than 48 hours, preferably the degradable tape or both tape and plug lose more than 80% of a starting weight in 48 hours or less, or 24 hrs or less.

Any method or well herein, wherein the plug or the plugged section of well can withstand pressure testing, e.g., at 5,000 psi for at least 12 hours, or at 10,000 psi for at least 0.5 hours.

Any method or well herein, wherein the first and second blocking device are independently selected from a plug, a packer, or a basket.

Any method herein, wherein the aqueous degrading fluid is acidic or an acidic brine.

Any method or well herein, wherein the degradable plug comprises a dissolving metal and the degrading thread tape comprises a dissolving polymer.

Any method herein, wherein the one or more degradation fluid(s) comprises a first degradation fluid used on the degradable thread tape and a second degradation fluid used on the degradable plugs.

As used herein, "degrading" and its variants are intended to be read broadly to include a variety of processes to remove a component, including processes of solubilizing, melting, disaggregating, monomerizing, and other sorts of chemical degradation or destruction.

"Dissolving" by contrast is to become or cause to become incorporated into a liquid so as to form a solution.

As used herein, a "degradation fluid" is one that will degrade a degrading plug or tape, leaving no discernable solids.

As used herein, a "dissolution fluid" is one that will dissolve a dissolving plug or tape, leaving no discernable solids.

As used herein, a "degrading plug" is a downhole temporary plug that serves to temporarily plug a well or a portion thereof for a period of time, but will dissolve, melt, disaggregate, or otherwise degrade under specified conditions in a degradation fluid, comprising any one or more of water, solvents, acid, caustic and/or heat. A "dissolving plug" is one that is primarily removed by dissolution processes, although other processes may of course contribute in the complex downhole environment.

As used herein, a "tape" or "thread tape" is a long flat strip of material that can be used to seal the threads or other connecting surfaces.

As used herein, a "degrading tape" is one that dissolves, melts, disaggregates, or otherwise degrades under specified conditions in a degradation fluid, leaving no discernable solid remnants in the downhole environment. A "dissolving tape" is a tape that is primary dissolved, although other processes can contribute to tape removal.

"Tubular" or "tubing" can be used generically to refer to any type of oilfield pipe, such as drill pipe, drill collars, pup joints, casing, production tubing and pipeline.

As used herein, a "joint" is a length of pipe, usually referring to drillpipe, casing or tubing. While there are different standard lengths, the most common drillpipe joint length is around 30 ft [9 m]. For casing, the most common length of a joint is 40 ft [12 m].

As used herein, a "tubular string" or "tubing string" refers to a number of joints, connected end to end (one at a time) so as to reach down into a well, e.g., a tubing string lowers a sucker rod pump to the fluid level. "Casing string" has a similar meaning, as applied to casing.

The use of the word "a" or "an" when used in conjunction with the term "comprising" in the claims or the specification means one or more than one, unless the context dictates otherwise.

The term "about" means the stated value plus or minus the margin of error of measurement or plus or minus 10% if no method of measurement is indicated.

The use of the term "or" in the claims is used to mean "and/or" unless explicitly indicated to refer to alternatives only or if the alternatives are mutually exclusive.

The terms "comprise", "have", "include" and "contain" (and their variants) are open-ended linking verbs and allow the addition of other elements when used in a claim.

The phrase "consisting of" is closed, and excludes all additional elements.

The phrase "consisting essentially of" excludes additional material elements, but allows the inclusions of non-material elements that do not substantially change the nature of the invention.

The following abbreviations or terms are used herein:

| TERM | MEANING |
|---|---|
| API | AMERICAN PETROLEUM INSTITUTE, WHICH PROMULGATES TUBING STANDARDS, ETC. |
| CMC | CARBOXYMETHYL CELLULOSE |
| DMAC | DIMETHYLACETAMIDE |
| DMF | DIMETHYLFORAMIDE |
| DOGLEG | A PARTICULARLY CROOKED PLACE IN A WELLBORE WHERE THE TRAJECTORY OF THE WELLBORE IN THREE-DIMENSIONAL SPACE CHANGES RAPIDLY. WHILE A DOGLEG IS SOMETIMES CREATED INTENTIONALLY BY DIRECTIONAL DRILLERS, THE TERM MORE COMMONLY REFERS TO A SECTION OF THE HOLE THAT CHANGES DIRECTION FASTER THAN ANTICIPATED OR DESIRED, USUALLY WITH HARMFUL SIDE EFFECTS. |
| EVA | ETHYLENE VINYL ACETATE |
| HNBR | HYDROGENATED ACRYLONITRILE BUTADIENE RUBBER |
| HPMC | HYDROXYPROPYL METHYLCELLULOSE |
| MMCR | MICRO MATRIX ® CEMENT RETARDER |
| NBR | NITRILE RUBBER OR ACRYLONITRILE BUTADIENE RUBBER |
| PAC | POLYANIONIC CELLULOSE |
| PLA | POLYLACTIC ACID |
| PPF | POUNDS PER FOOT |
| PTFE | POLYTETRAFLUOROETHYLENE |
| PVOH | POLYVINYL ALCOHOL |
| VAE | VINYL ACETATE-ETHYLENE COPOLYMER |

-continued

| TERM | MEANING |
|---|---|
| PSI | POUND-FORCE PER SQUARE INCH |
| KSI | KILOPOUND FORCE PER SQUARE INCH-EQUIVALENT TO A THOUSAND PSI (1000 LBF/IN2) |
| PEU | POLYETHERURETHANE |
| PU | POLYURETHANE |

DETAILED DESCRIPTION

Figure 1:
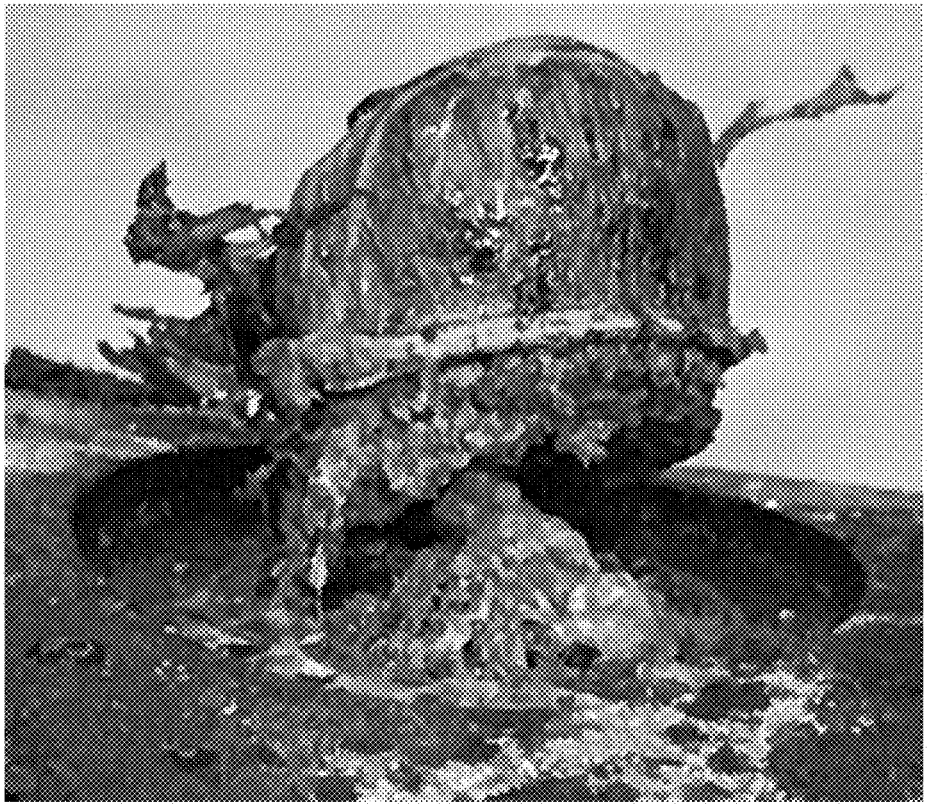
FIG. 1 Prior art use of TEFLON™ tape (yellow), which does not degrade and which also impedes plug degradation.

Developed herein are methods of temporarily plugging a well, systems of temporarily plugged wells, and dissolvable tape and plugs for same.

A dissolvable or degradable tape used to provide pressure-stable seals for downhole plugs and the like must meet a number of requirements. First, the tape should have high tensile strength and also sufficient flexibility (e.g., Shore D of 50-72 tensile strength at break 2000-5000 psi; tear strength at 150° C. of about 14 to 20 N/mm$^2$; elongation at break 50%-200%; sealability (ASTM F37) about 0.14-2 ml/hr or about 0.16 ml/hr; compressibility (ASTM F-36) of about 60-70% or about 66%; recovery (ASTM F-36) of about 29 to 39 N/mm$^2$; creep relaxation (ASTM F-38) of about 35-40% or about 38%), so that it can wrap any threaded connector and provide a seal against pressures as high as 10,000 psi.

Second, the tape should also be chemically stable under downhole conditions of heat and well fluids for a defined minimum length of time, such as e.g., 24-48 hours. For example, operating temperatures of 150-300° C., melt temperature>350 or >400° C.; not readily soluble in crude oils.

Third, it should be readily and quickly dissolvable when a dissolving fluid is pumped down hole, leaving no discernable tape debris behind to clog or damage equipment. In addition, the optimal tape may vary for different wells, depending on the differing downhole conditions and differing well stimulation techniques that may be used.

Any dissolvable or degradable polymer can be formulated into a thin film tape and used herein. The exact conditions for dissolution/degradation can be controlled with the degree of crosslinking, the average molecular weight of the polymer, and the use of one or more coatings to delay the onset of dissolution/degradation. See e.g., U.S. Pat. Nos. 6,380,138, 5,837,656 describing resin coated particles comprising a particulate substrate, an inner coating of a curable resin and an outer coating of a substantially cured resin. Additional coating patents are listed at the list of art incorporated by reference.

Several dissolvable polymers are known, although they are not used in degrading thread tape applications. For example, polyetherurethane (PEU) will dissolve in dimethylforamide (DMF) or dimethylacetamide (DMAc), polylactic acid (PLA) is dissolvable in $CHCl_3$, $CH_2Cl_2$, acetone, hexafluoroisopropanol, and the like. Other water-soluble polymers include vinyl acetate-ethylene copolymer (VAE), polyvinyl alcohol (PVOH), ethylene vinyl acetate emulsions (EVA), carboxymethyl cellulose (CMC), polyanionic cellulose (PAC), hydroxypropyl methylcellulose (HPMC), and the like. Silicon can be dissolved with strong acids, polar organic solvents, or DYNASOLVE 230 (by DYNOLOGY®).

The dissolving or degrading thread sealant tape used herein can be used with any degrading plug. As noted above, several such plugs are commercially available (e.g., HALLIBURTON'S™ ILLUSION™ frac plug, VERTECH'S™ WIZARD™ plug, MAGNUM OIL'S™ FASTBALL™, INNOVEX'S™ SWAGE™ frac plug, and BAKER HUGHE'S™ SPECTRE™ frac plug). In addition, several more are described in the patents incorporated by reference in its entirety herein. Ideally, both the plug and the tape would degrade under the same degradation fluids, but it is also possible to use two fluids sequentially if needed. If this is done, it may be preferred to dissolve the tape in advance of the plug, thus improving access to the plug by the degradation fluid.

Proof of Concept Testing

One stage of recovering hydrocarbon products such as oil and natural gas is known as "completion". Completion is the process of preparing an already drilled well for production and often includes hydraulic fracturing and other well stimulation procedures. Completions also frequently include cementing operations in which cement is pumped through the casing in order to cement the casing into the wellbore. Cementing operations typically include "wiping" the well bore by pumping down the casing a wiper plug in order to "wipe" excess or superfluous cement from the casing.

After cementation the well bore must be re-opened down hole in order to establish communication for stimulation and production. This is typically done with what is known as a "toe valve" or an "initiation valve." Certain toe valves may be opened by pressuring up on fluid in the casing, i.e., pressure activated toe valves. However, it is typically desirable to pressure test the casing prior to opening the toe valve(s).

We propose to use degradable casing plugs to replace toe valves, or coiled tubing perforating during pre-frack completion operations—an innovation that could save as much as $40,000 per well.

Figure 2:
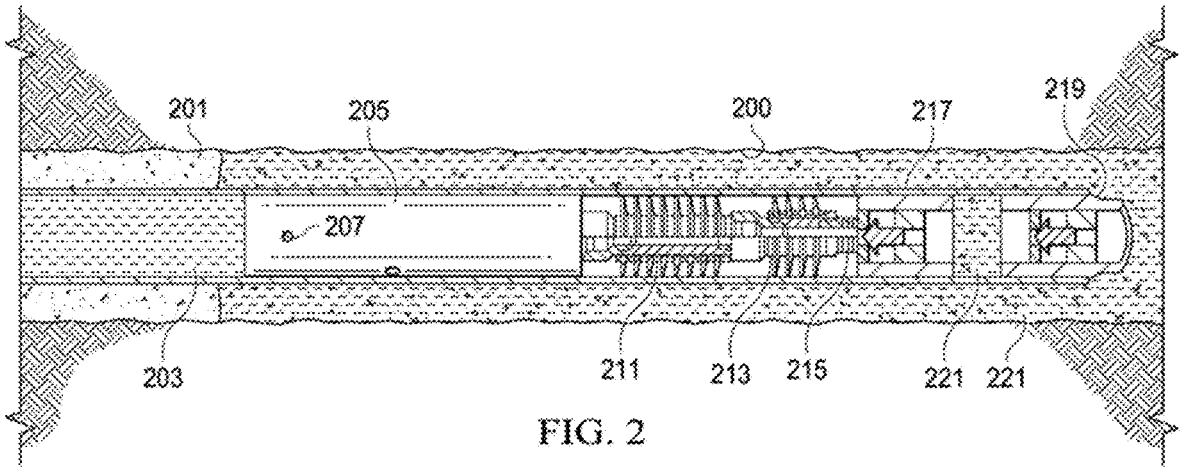
FIG. 2 Use of degradable plugs and degradable thread tape at the toe of a well.

FIG. 2 shows an exemplary setup in well 200, that is cemented 201 around tubing 205 having threaded ports 207 into which are fitted threaded plugs 209 (degradable tape 210 not visible). Also shown is top wiper plug 211, bottom wiper plug 213, burst disk 215, dual latch collar 217, and float shoe 219. The degradation fluid 203 and contaminated cement and drillwater 221 are also shown.

Figure 7A:
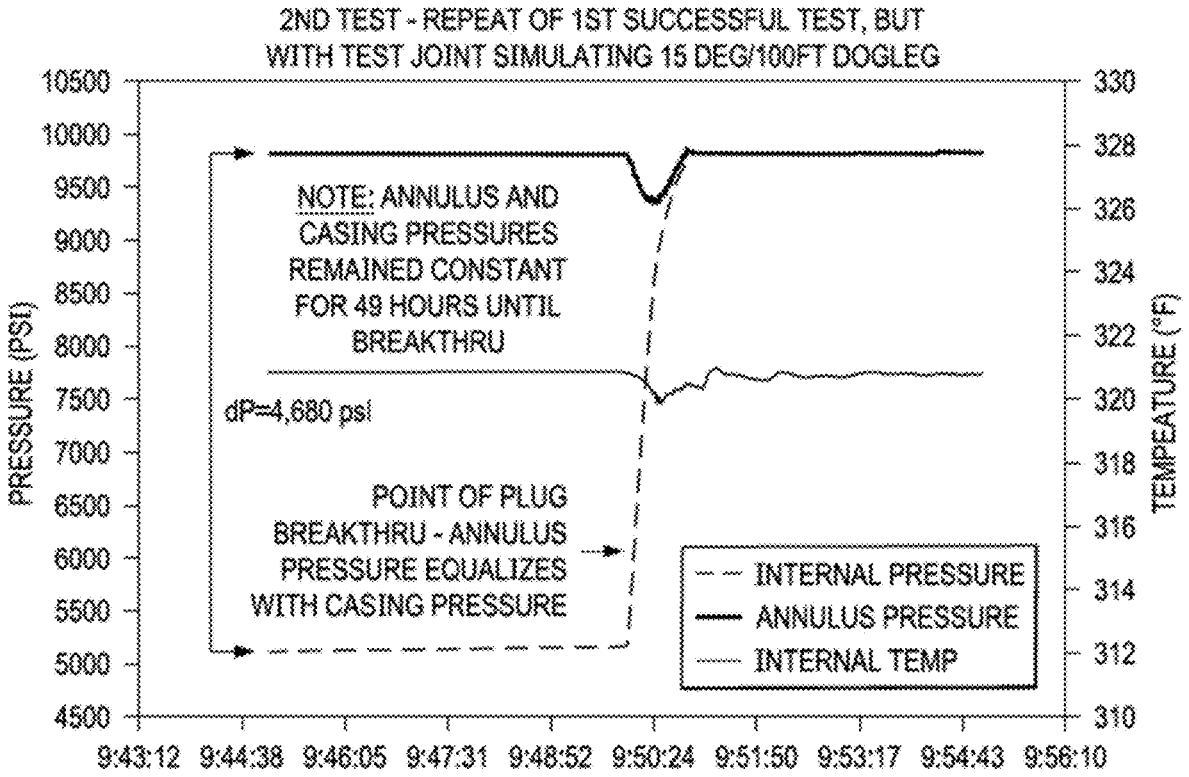
FIG. 7A-B. Degradable plug field test (FIG. 7A) using water plus MMCR at 320° C. to degrade the plugs, which were set at 60° rotations 6 holes per foot in 3×45 foot joints which were cemented with a wet shoe (FIG. 7B).
Figure 7B:
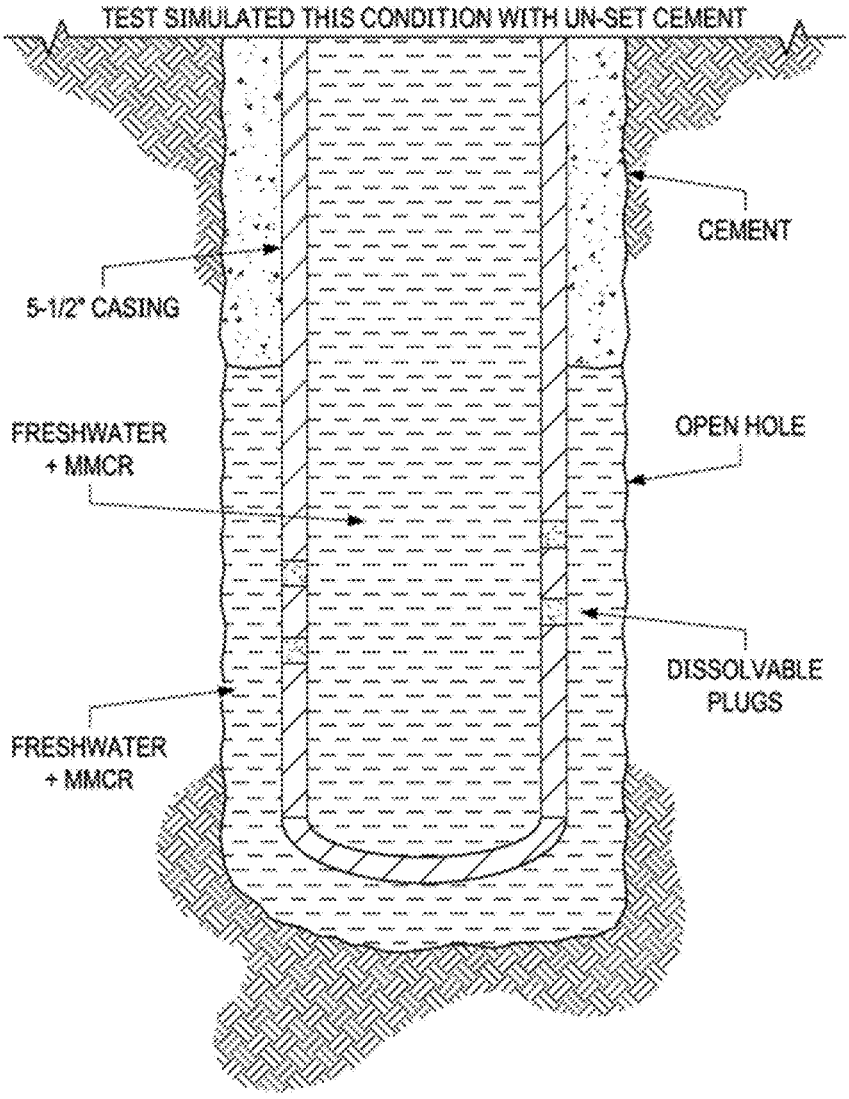

We tested the idea under laboratory conditions, using 48 threaded holes drilled into a 15 ft casing joint (FIG. 3) housed inside a chamber under suitable temperature, pressure and fluid conditions. However, we found that 60 degree phasing of holes provided the best lateral crush resistance (FIG. 4), and this phasing was chosen for subsequent testing (FIG. 7B).

Figure 3:
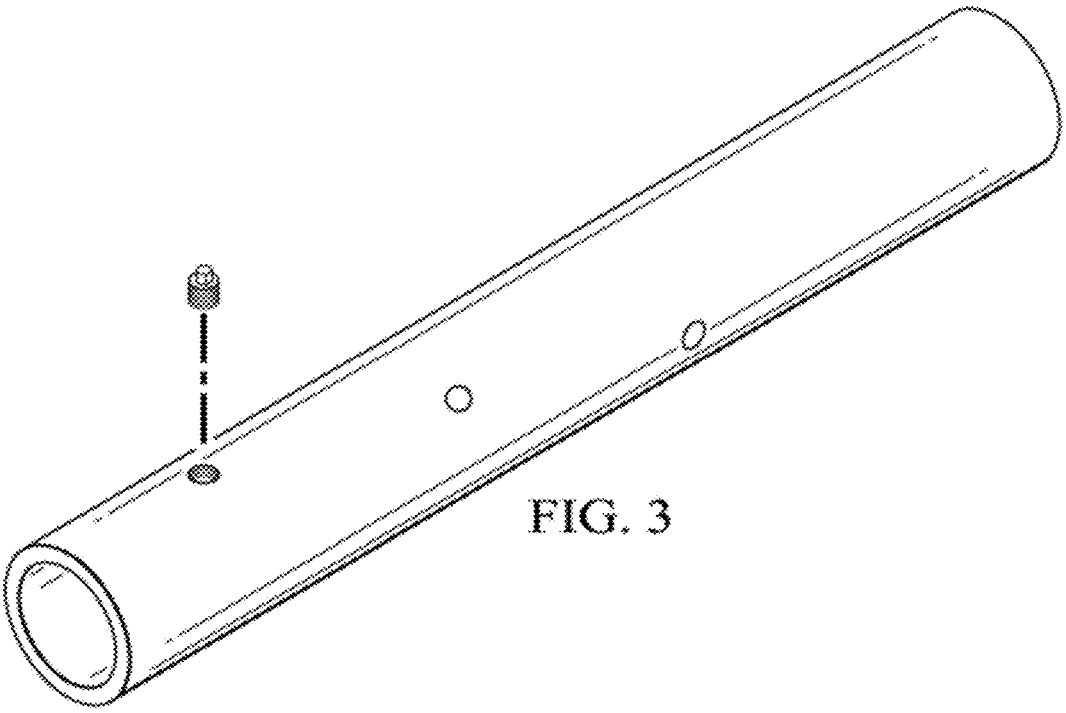
FIG. 3 Close up of joint section with holes/ports and one example of a threaded plug.
Figure 4:
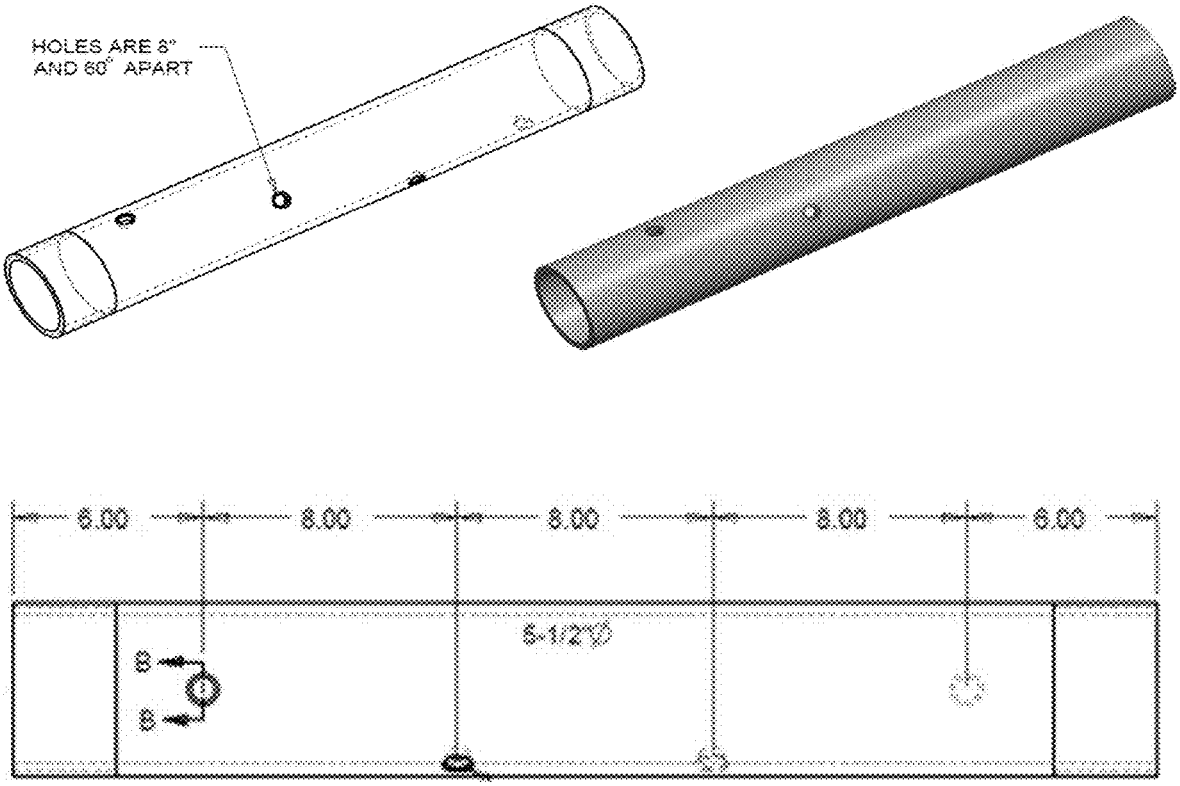
FIG. 4. Ports provided in a section of joint at 60° rotation, 8 inches spirally apart and 6 holes per foot.
Figure 5:
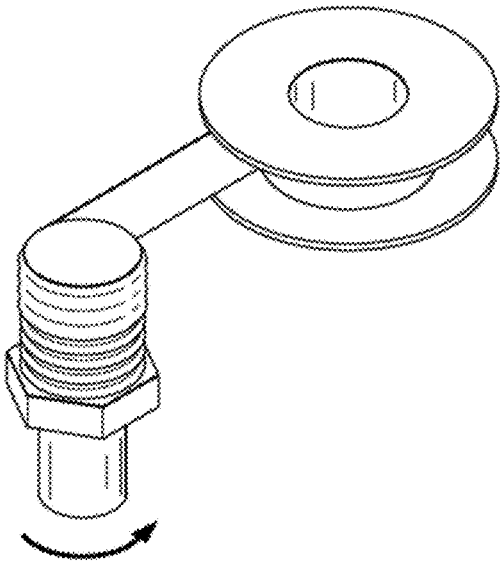
FIG. 5. Wrapping a threaded plug with tape.

The holed section of piping was installed in the shoe track above the latch collar, and the ports stopped with plugs and sealant tape (FIG. 3, FIG. 5). The casing pressure was tested after bumping the cement plug. Plugs must hold pressure for minimum 12 hrs, but are also to dissolve in less than 48 hrs and flow to be established through the ports prior to frac operations.

In more detail, the test was performed at 320° F. and 10,000 psi. The plugs were for P110 casing size 5½", 23 ppf. We used NexGen® magnesium alloy plugs, which are rated for a maximum pressure of 10,000 psi at 200° F.-300° F. These plugs dissolve in fresh water or 1%-3% KCL in 24-48 hours.

Figure 6:
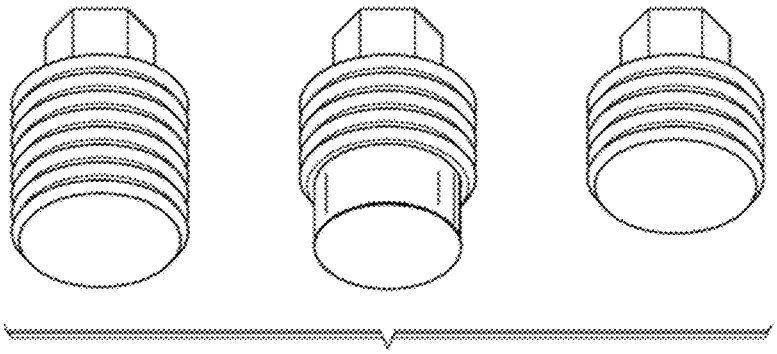
FIG. 6. Three plug designs, wherein maximal plug material (left) slows degradation time. The fastest degrading plug is the short plug on the right. All three plug designs passed the pressure test at downhole temperatures (320° C.).

Although we tested several plug designs, the best performing were extruded plugs with 5/16 hex heads that could be twisted off, providing a smooth exterior to tubulars. A ¼ inch head could be twisted off at 8 ft/lbs torque, but increasing to 5/16 allowed increased torque to 12 ft/lbs. Various plug shapes were tested (see FIG. 6), the variation allowing us to control degradation time.

The dissolving fluid used in our tests was drill water plus MMCR—MICRO MATRIX® CEMENT RETARDER (MMCR) a liquid retarder designed for use in MICRO MATRIX® cement. We used a 5,000 psi differential pressure during dissolve period. We also simulated a representative dogleg severity (15 deg/100 ft). For a successful test, the plug/tape combination needed to hold pressure tests as follows:

5 ksi test hold for 30 min 10 ksi test hold for 30 min 5 ksi test hold for 12 hrs When we tested degradable plugs using LOCTITE™ and 4 wraps of the typical TEFLON™ tape, we found that the TEFLON™ had a tendency to hold the plug material, preventing complete dissolution, and even when soaked an additional time with light swirling to fully dissolve the plug, the TEFLON™ tape remained behind, providing significant material that could clog downstream equipment. Thus, we know that TEFLON™ thread tape is significantly less than optimal.

Although the TEFLON™ tape was not optimal, we found that the plugs themselves held up for at least 49 hours when tested with at flat face at each port in a tubular. See FIG. 7A. A field trial was also conducted (not shown) and we were able to use the degrading plugs to successful perform first stage of hydraulic fracturing. Thus, we anticipate significant costs savings using threaded degradable plugs in future completions.

Figure 8:
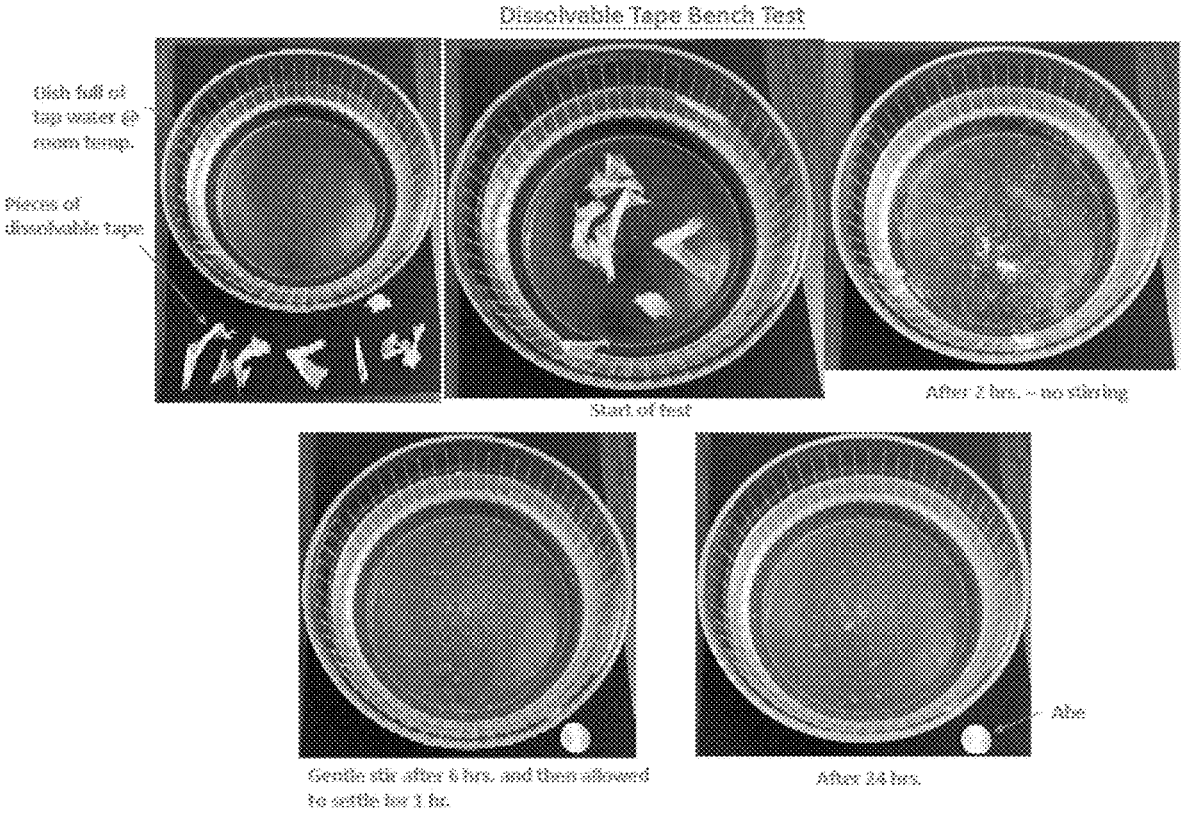
FIG. 8. Bench test of dissolvable PLA tape.

We have also performed a bench top test using a PLA tape, and that tape dissolved satisfactorily in a few hours. See FIG. 8. Thus, our next steps are to combine the degrading tape with the degrading plugs already tested. However, this initial work indicates a very strong likelihood of success.

We may also test a dissolvable tape comprising DEP88X from BUBBLETIGHT®.

| | TESTING STANDARD | DEP88X ™ | NBR* | HNBR* |
|---|---|---|---|---|
| HARDNESS (SHORE A) | ASTM D-2240 | 87-89 | 80-85 | 92-98 |
| TENSILE STRENGTH, PSI | ASTM D-412 | 2320 | 2280 | 8429 |
| ULTIMATE ELONGATION, % | ASTM D-412 | 219 | 260 | 140 |
| MODULUS @ 100%, PSI | ASTM D-412 | 7680 | 820 | 3550 |

*NBR & HNBR Values are for reference only

Other degradable materials by the same company include:

DCM 2× Freshwater degradable composite metal.

DCP 1× Ambient-temperature fresh-water degradable composite metal

DEP 88× Ambient-temperature fresh-water degradable elastomeric polymer

DCM HP High-strength brine-degradable composite metal

We predict that these degradable tapes can be removed on 48 hours or less treatment with a degradation fluid, and will provide a great improvement over prior art non-dissolving sealant tapes such as TEFLON™. Yet at the same time, the method of use is consistent with the methods already employed when a TEFLON™ tape is used to wrap threads. Thus, there is no learning curve or change in methodology needed to implement the degradable tape, especially when the plug and tape are selected so as to degrade in the same degradation fluid.

We have now tested the complete invention downhole, by pumping an intentional wet shoe during the drilling operation by over displacing the cement with freshwater by 20 bbls. When completion operations begin, flow through the well can be immediately established without the need for toe valves or tubing conveyed perforations. After pumping a wet shoe, a production casing test cannot be obtained without setting a plug to test against. For this reason, this method is not commonly used.

However, with our invention it is now possible to pump a wet shoe AND obtain a successful production casing pressure test. This can be achieved by installing casing at the toe of the well with pre drilled ports and plugging the ports with dissolvable material, as herein described. The goal was to develop a system that is fully debris avoidant and eliminate plugged off toe valves from normal operations.

Our tests were successful, and the closed section was able to hold 11,000 psi for 10 minutes (data not shown). Once dissolved, we were able to successfully inject through the now opened ports. No debris problems were detected.

The following documents are incorporated by reference in their entirety for all purposes:

US20050205264 Dissolvable downhole tools

US20150119301 Flash Coating Treatments For Proppant Solids

US20150354310 Dissolvable downhole plug

US20170234103 Dissolvable downhole tools comprising both degradable polymer acid and degradable metal alloy elements U.S. Pat. No. 5,607,017 Dissolvable well plug U.S. Pat. No. 5,837,656 Well treatment fluid compatible self-consolidating particles U.S. Pat. No. 6,380,138 Injection molded degradable casing perforation ball sealers fluid loss additive and method of use U.S. Pat. No. 7,493,956 Subsurface safety valve with closure provided by the flowing medium U.S. Pat. No. 8,887,816 Polymer compositions for use in downhole tools and components thereof U.S. Pat. No. 9,151,143 Sacrificial plug for use with a well screen assembly U.S. Pat. No. 9,416,903 Method and device for removal of a hydrate plug U.S. Pat. No. 9,757,796 Manufacture of controlled rate dissolving materials.

WO2017200864 Slow-release scale inhibiting compositions

WO2017209914 Dissolvable rubber

Miller-Chou, B. A., & Koenig J. L, A review of polymer dissolution, Prog. Polym. Sci. 28 (2003) 1223-1270, available online at courses.sens.buffalo.edu/ce435/Koenig03.pdf

What is claimed is:

1. A method of temporarily plugging a hydrocarbon well, comprising:

a) providing a section of tubing in a well, said tubing having one or more threaded ports therein, each of said one or more threaded ports having a degradable plug having threads therein, said threads wrapped with a degradable thread tape, said degradable plug and said degradable tape arranged so as to plug each of said one or more ports, thus providing a plugged section of well;

b) performing a downhole activity in said plugged section of well for a period of time; and c) providing one or more degrading fluid(s) downhole to degrade said degradable plug and to degrade said degradable tape leaving no discernable solids, thereby opening said plugged section of well.

2. The method of claim 1, wherein said degradable plug and said degradable tape are degradable in aqueous solution in less than 48 hours.

3. The method of claim 2, wherein said degradable plug and said degradable tape lose more than 80% of a starting weight in 48 hours or less when exposed to said aqueous solution.

4. The method of claim 2, wherein said degradable plug and said degradable tape lose more than 80% of a starting weight in 24 hours or less when exposed to said aqueous solution.

5. The method of claim 1, wherein said downhole activity comprises pressure testing said plugged section of well.

6. The method of claim 1, wherein said downhole activity comprises pressure testing said plugged section of well at 5,000 psi for at least 12 hours.

7. The method of claim 1, wherein said downhole activity comprises pressure testing said plugged section of well at 10,000 psi for at least 0.5 hours.

8. The method of claim 1, wherein said section of well is a toe section.

9. The method of claim 1, said method further comprising providing one or more blocking devices above and below said section, wherein said blocking devices are selected from a plug, a packer, a basket, or combinations thereof.

10. The method of claim 1, wherein a first degrading fluid degrades said degradable thread tape and a second degrading fluid degrades said degradable plug.

11. The method of claim 1, wherein said degradable thread tape does not degrade in crude oil at a temperature of up to 300° C. for at least one month.

12. The method of claim 1, wherein said ports are staggered at 60° from one another around said tubing.

13. The method of claim 1, wherein said degradable plug has a hex head that is removable with torque on completion of installation of said plug into said tubing.

14. A method of temporarily plugging a hydrocarbon well, comprising:

a) deploying a first blocking device downhole to block a bottom of a section of well to be plugged, said section of well having tubing with one or more threaded ports plugged with a degradable plug having threads, said threads wrapped with a degradable thread tape;

b) deploying a second blocking device above said section, thereby providing a plugged section;

c) pressure testing said plugged section for a period of time to confirm that said plugged section will hold at least 5,000 psi for 12 hours or at least 10,000 psi for 10 minutes; and d) deploying one or more aqueous degrading fluid(s) downhole to degrade said degradable plug and said degradable tape in 48 hours or less.

15. The method of claim 14, wherein said degradable plug and said degradable tape lose more than 80% of a starting weight in 48 hours or less when exposed to said one or more aqueous degrading fluid(s).

16. The method of claim 14, wherein said degradable plug and said degradable tape lose more than 80% of a starting weight in 24 hours or less when exposed to said one or more aqueous degrading fluid(s).

17. The method of claim 14, wherein said first and second blocking device are independently selected from a plug, a packer, or a basket.

18. The method of claim 14, wherein said section of well is a toe section.

19. The method of claim 14, wherein said aqueous degrading fluid is acidic or an acidic brine.

20. The method of claim 14, wherein said degradable plug comprises a dissolving metal and said degrading thread tape comprises a dissolving polymer.

21. The method of claim 14, wherein said one or more degradation fluid(s) comprises a first degradation fluid used on said degradable thread tape and a second degradation fluid used on said degradable plugs.

22. The method of claim 14, wherein said ports are staggered at 60° from one another around said tubing.

23. The method of claim 14, wherein said degradable plug has a hex head that is removable with torque on completion of installation of said plug into said tubing.

24. A hydrocarbon well, said hydrocarbon well comprising tubing in an underground reservoir of hydrocarbon, said tubing having a plurality of holes therein, one or more of said holes being blocked with a degradable plug having threads, said threads wrapped with a degradable tape that is degradable with a degradation fluid to produce no discernible solids, said blocked holes able to withstand least 5,000 psi for 12 hours.

25. A hydrocarbon well, said hydrocarbon well comprising tubing in an underground reservoir of hydrocarbon, said tubing being blocked with a degradable plug wrapped with degradable tape, said degradable plug and said degradable tape losing 80% or more of a starting weight in 48 hours or less when exposed to one or more aqueous degrading fluid(s).

* * * * *